United States Patent [19]

Wagoner

[11] 4,397,399

[45] Aug. 9, 1983

[54] SEAL FOR FLOATING ROOFS OF STORAGE TANKS

[75] Inventor: Robert B. Wagoner, Broken Arrow, Okla.

[73] Assignee: Tank Services, Incorporated, Tulsa, Okla.

[21] Appl. No.: 299,830

[22] Filed: Sep. 8, 1981

[51] Int. Cl.[3] ..... H05B 1/00; A45D 1/04

[52] U.S. Cl. ..... 220/222; 220/220; 220/224

[58] Field of Search ..... 220/216–227

[56] References Cited

U.S. PATENT DOCUMENTS

| | | | |
|---|---|---|---|
| 3,618,813 | 11/1971 | Nishkian | 220/222 |
| 3,795,339 | 3/1974 | Barbier | 220/222 |
| 4,273,250 | 6/1981 | Kinghorn et al. | 220/222 |
| 4,276,991 | 7/1981 | Gunther | 220/222 |

*Primary Examiner*—Robert I. Smith

*Attorney, Agent, or Firm*—Head, Johnson & Stevenson

[57] ABSTRACT

A sealing assembly comprising a flexible shield having one end rigidly connected to an upper rim portion of a floating roof movably disposed within a storage tank and having the opposite end thereof extending upwardly and outwardly toward the inner periphery of the tank, a flexible wiper blade connected to the outwardly extending end of the shield for engaging the inner surface of the tank wall, the combined shield and wiper blade being of a length greater than the average width of the rim space for assuring an efficient sealing engagement of the wiper blade with the inner periphery of the tank wall even during lateral movement of the floating roof within the tank, and a yieldable film or sheet interposed between the shield and the rim of the roof for assuring an efficient seal therebetween.

9 Claims, 8 Drawing Figures

SEAL FOR FLOATING ROOFS OF STORAGE TANKS

BACKGROUND OF THE INVENTION

1. Field of the Invention

This invention relates to improvements in sealing devices and more particularly, but not by way of limitation, to a combination weather and vapor seal for covering the rim space between the inner wall of a storage tank and the floating roof thereof.

2. Description of the Prior Art

Petroleum products, such as gasoline and the like, are usually stored in large cylindrical tanks having a roof which is supported on or floats on the surface of the product contained within the tank. As the level of the fluid within the tank rises or falls, the roof rises and falls freely therewith. The outer diameter of the floating roof is normally smaller than the inner diameter of the tank, and the annular space between the outer periphery of the roof and inner periphery of the tank is commonly called the "rim space". If this "rim space" is not covered in some manner, the product stored in the tank may be contaminated by the ambient weather conditions, which is a detriment, and furthermore, vapors from the stored product may escape through the "rim space" resulting in a loss of the product. In view of the current world wide shortage of petroleum products, it has become more and more important to protect the stored products from contamination due to weather conditions and to reduce loss of the product through the escape of the vapors.

In the past it has been a common practice to provide a seal for the rim space which extends between the inner tank wall and the top of the roof, and is mounted in such a manner as to move up and down with the movement of the roof. One particularly effective prior art seal includes a flexible metal shield which is mounted to the upper perimeter of the roof and extends diagonally upwardly toward the inner wall of the tank. A yieldable wiper blade is mounted on the end of the shield for engaging and pressing against the inner wall of the tank. One disadvantage of this type seal is that the usual rim space is of a variable width dimension throughout the annular extension thereof, and as a result an effective or efficient engagement between the inner periphery of the tank wall and the yieldable seal means is difficult to maintain. In addition, when the wiper blade is in a minimum pressure engagement with the tank wall, the wiper blade may "hang up" momentarily at an inwardly protruding weld seam in the tank wall as the roof moves upwardly within the tank. The remaining portion of the wiper may move upwardly with respect to the "caught" portion thereof, which may result in a permanent deformation of the wiper blade. A still further detriment or disadvantage of this type seal is the fact that the metal shield is not a unitary continuous piece that extends completely around the rim space, but rather comprises a pluraklity of adjacent shield sections which lap or abut one another. The joints between the adjacent sections of the shield provide areas of possible escape of the vapors from the interior of the tank. Even though these losses may not be great, the current energy shortage coupled with environmental concerns increases the problem. Additionally, it is frequently found that these sealing devices permit the temperatures within the rim space to reach undesirably high levels, which accelerates the generation of vapors from the product contained within the tank. This creates a greater depletion of the stored product and renders containing of the vapors more difficult.

In order to overcome these particular disadvantages, an improved seal has been developed for the rim space of a storage tank as shown in the Kinghorn et al U.S. Pat. No. 4,161,358, of which I am a co-inventor. The sealing means shown in my prior patent includes a flexible shield having one end rigidly connected to an upper portion of a floating roof of a storage tank and a second end extending upwardly and outwardly toward an interior wall of the tank. A flexible wiper blade is connected to the extending end of the shield for engaging the inner surface of the tank wall. The combined shield and wiper blade extend from the upper portion of the roof to the interior tank wall at an acute angle with respect to the horizontal, and the length of the shield is greater than the average rim space dimension divided by the cosine of the angle of the shield with the horizontal. This particularly selected dimensioning of the shield provides an effective seal between the wiper blade and the interior wall of the tank even when the rim space varies with lateral motion of the floating roof. One embodiment of the sealing means shown in my prior patent includes a double seal means at the rim, spaced between the floating roof and tank wall to even further increase the sealing efficiency and reduce loss of vapors from the product contained within the tank. The present day environmental standards and energy concerns have placed great demands on the design of the sealing elements for these floating roofs, and it may be that all such floating roofs will ultimately be required to have a double sealing arrangement at the rim space.

One disadvantage of the sealing means shown in my prior patent is the manner in which the flexible metal shield means is secured to the floating roof. The connection between the shield and the roof structure is a metal-to-metal seal and whereas the engagement of the yieldable sealing member with the wall of the tank is efficient, there has been leakage at the connection between the metal shield and the roof itself, which may not provide a sufficiently efficient seal for meeting the stringent requirements now placed on such structures.

SUMMARY OF THE INVENTION

The present invention contemplates a novel double seal means for the rim space between a floating roof of a storage tank and the inner periphery of the tank walls which has been particularly designed and constructed for overcoming the foregoing disadvantages. The novel sealing means comprises a liner member, a preferably constructed from urethane, or the like, extending along one face of the metal shield and secured between the edge of the metal shield and the upper portion of the roof structure, thus providing an extremely efficient seal between the shield and roof itself. Of course, it is also important to reduce static electricity conditions in and around the roof structure, particularly in the light of the volitile nature of the product normally stored within the tank, and in order to reduce or substantially eliminate this hazard, static drain strips are spaced around the circumference of the roof structure, said static drains providing a metal-to-metal contact for draining static electricity generated by the friction between the wiper blades and the inner periphery of the tank wall. The novel improved sealing means of the invention may be readily installed on substantially any existing floating rod construction, and is simple and efficient in operation and economical and durable in construction.

DETAILED DESCRIPTION OF THE PREFERRED EMBODIMENT

Figure 1:
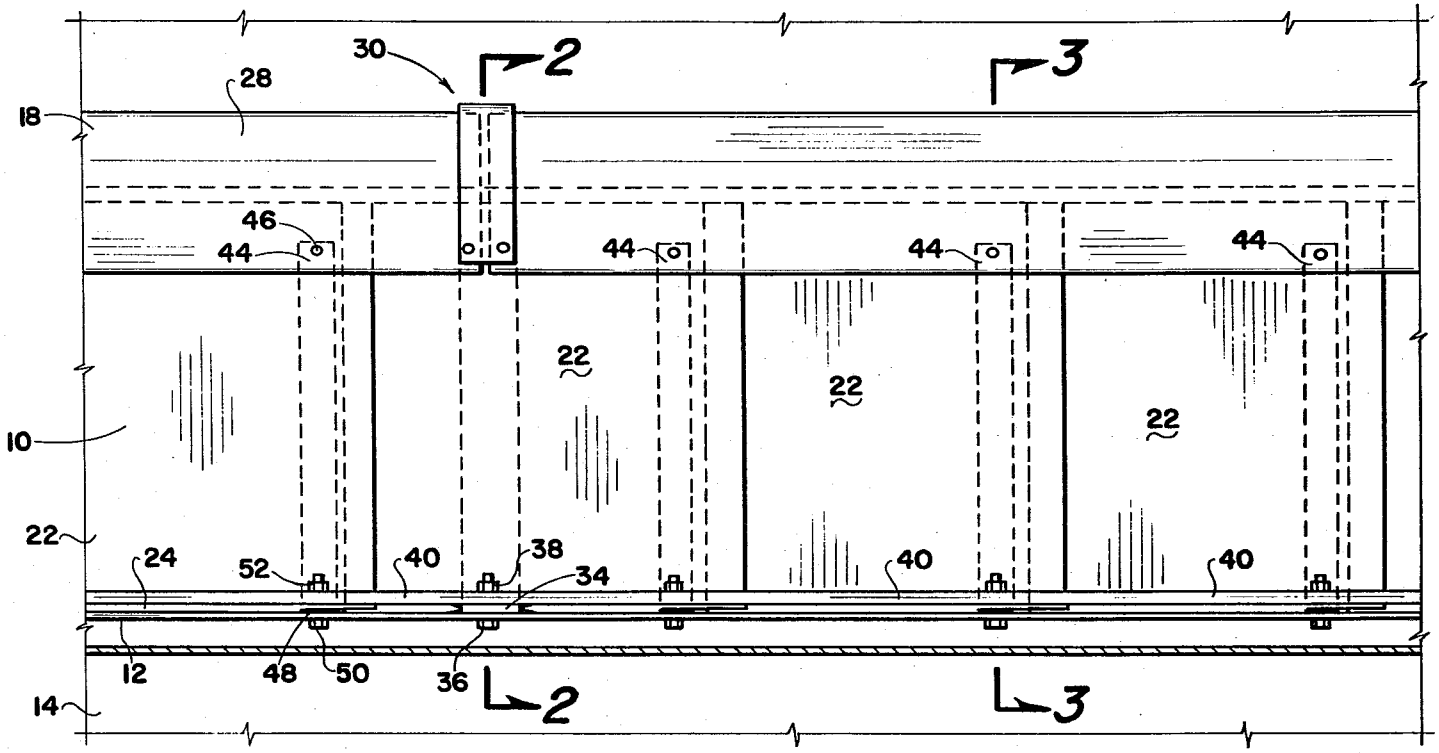
FIG. 1 is a front elevational view of a portion of a single sealing means embodying the invention and secured in the rim space between a floating roof structure and the inner periphery of the walls of a storage tank.
Figure 3:
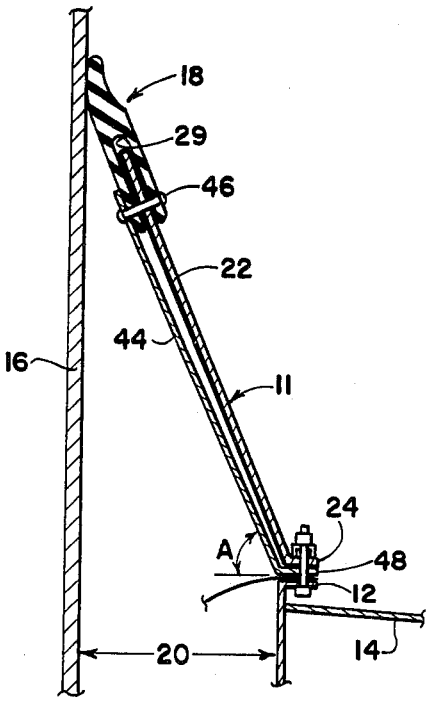
FIG. 3 is a view taken on line 3—3 of FIG. 1.
Figure 2:
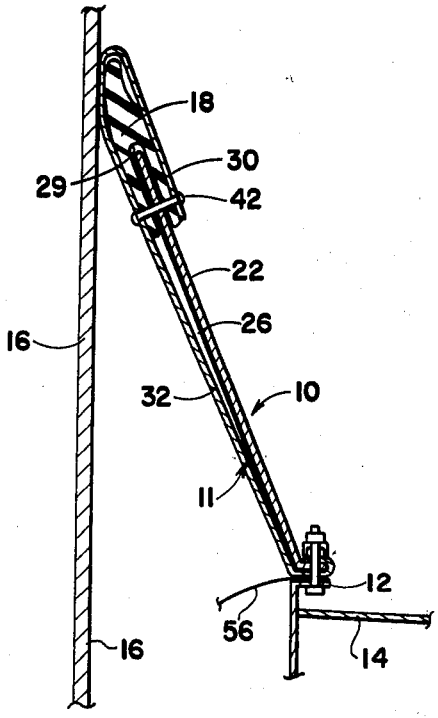
FIG. 2 is a view taken on line 2—2 of FIG. 1.

Referring to the drawings in detail, and particularly FIGS. 1, 2 and 3, reference character 10 generally indicates a rim space sealing apparatus comprising a flexible shield 11 having one end rigidly connected to an upper rim portion 12 of a floating roof 14 movably disposed within a storage tank 16 an having the opposite end thereof extending upwardly and outwardly toward the inner periphery of the tank 16. A flexible wiper blade 18 is connected to the outwardly extending end of the shield 11 for engaging the inner surface or inner periphery of the tank wall 16. The combined shield and wiper blade extend from the upper rim 12 of the roof to the inner periphery of the tank wall 16 at an acute angle A with respect to the horizontal, with the length of the shield 10 being a selected dimension greater than the average width of the rim space 20 dimension. This particularly selected diemsnion provides an effective sealing between the wiper blade 18 and the tank wall 16 even when the size of the rim space 20 varies during any lateral movement of the roof structure 14 with respect to the tank 16.

The shield 10 comprises a plurality of flexible metallic plates 22 arranged in either end-to-end abuttment or an end-to-end overlapping arrangement, as desired, and as shown in FIG. 1, to provide a continuous shield extending completely around the outer circumference of the rim 12 of the tank 14. In the event the rim 12 is of a horizontally extending type, as particularly shown in FIGS. 1, 2 and 3, the inner end of each plate 22 is formed with a corresponding flange 24 for disposition in substantial alignment with the rim 12. A sheet or film 26 of suitable yieldable material, such as urethane, is disposed against the outer surface of each of the plates 22, the outer surface being that surface open to the tank wall 16. The film 26 also extends along the under surface of each flange 24, and is thus secured between the flange 24 and the rim 12 when the plates 22 are secured thereto. In this manner an efficient seal is provided between the rim 12 and the flange 24 for cooperating with the seal between the wiper blade 18 and the tank wall 16 to substantially preclude contamination of the contents of the tank 16 from the atmosphere as well as substantially eliminate any loss of vapor from the interior of the tank.

The wiper blade 18 may be of any suitable construction, such as that shown in my aforementioned prior patent, but preferably as shown herein comprises a plurality of flexible or yieldable substantially rectangular strips 28 mounted in end-to-end abutting relationship, as particularly shown in FIG. 1, to provide a continuous wiper blade extending around the entire circumference of the tank wall 16. Each strip 28 is preferably constructed from rubber, neoprene, or the like, and is provided with an elongated slit or recess 29 extending along the inner end thereof for receiving the outer end of an associated plate member 22 therein. The abutting ends of adjacent strips 28 are preferably secured together by means of a static drain member 30 which comprises an elongated metallic strip 32 (FIG. 2) having the inner end thereof formed into a substantially U-shaped flange 34 extending around the flange 24. The flanges 34 and 24 may be fastened to the rim 12 in any suitable manner, such as by a bolt 36 and cooperating lock nut 38 and C-bracket 40. The outer end of the strip 32 extends around the wiper ends of the abutting strips 28 and over the front surfaces thereof as viewed in FIG. 1. Suitable rivets 42, or the like, may be utilized for securing the strip 32 in position around and over the strips 32. Each strip 32 provides a metallic connection between the inner periphery of the tank wall 16 and the metallic rim 12 of the floating roof 14 for draining static electricity which may accumulate during the reciprocation of the roof within the tank.

It is also preferable to provide a protector strip 44 in the proximity of each overlapping or abutting joint between adjacent plates 22. The strips 44 may be constructed from any suitable material, and have one end thereof secured to the wiper strip 28 and plate 22 by suitable rivets 46, or the like. The opposite end of each strip 44 is provided with an outwardly extending flange 48 dapted to be interposed between the rim 12 and flange 24 of the plate 22. The rim 12 and flanges 24 and 48 may be secured together in any suitable manner, such as by a bolt 50 and cooperating lock nut 52 and C-bracket 40, as is well known.

It is to be noted that the roof 14 is frequently provided with a primary seal means shown schematically at 56 in FIGS. 2 and 3. These primary seals 56 are normally secured to the rim 12 and extend radially outwardly therefrom for engagement with the inner periphery of the tank wall 16 and are generally relatively ineffective for providing the sealing efficiency now required. Of course, the primary seal means 56 may remain in position upon the installation of the sealing assembly 10, and the sealing assembly 10 becomes a secondary sealing means for improving the overall efficiency of the storage tank 16 and floating roof 14.

Figure 5:
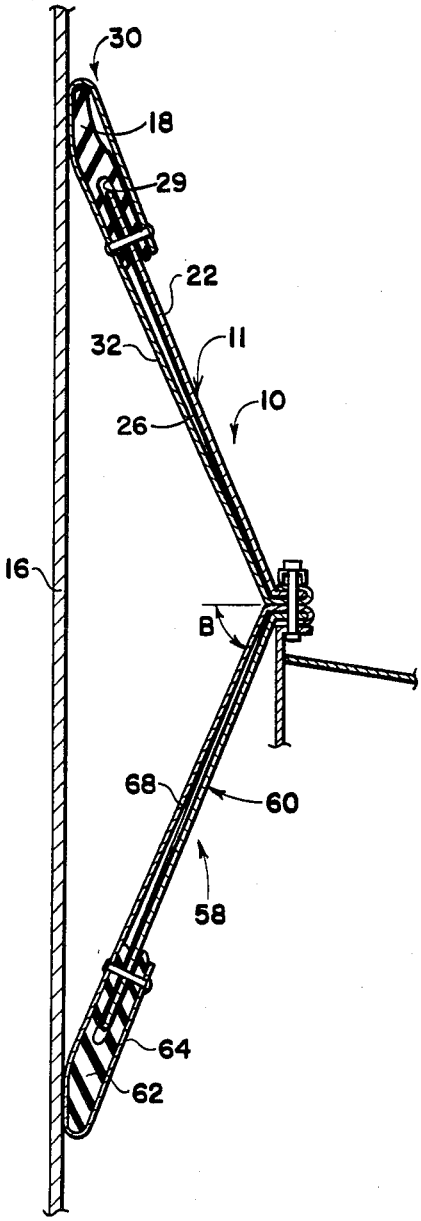
FIG. 5 is a view similar to FIG. 3 illustrating the double sealing means shown in FIG. 4.
Figure 4:
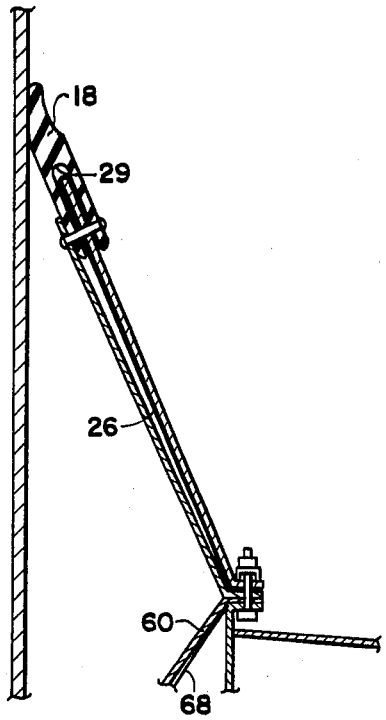
FIG. 4 is a view similar to FIG. 2 illustrating a double sealing means embodying the invention.

Referring now to FIGS. 4 and 5, a second sealing assembly generally indicated at 58 is shown which may be utilized in combination with the sealing assembly 10. The sealing assembly 58 is substantially identical to the sealing assembly 10 but oppositely disposed with respect thereto. The assembly 58 comprises a flexible shield 60 substantially identical to the shield 11 and having one end rigidly connected to the rim portion 12 and extending downwardly and outwardly therefrom toward the inner periphery of the tank wall 16. A flexible wiper blade 62 is connected to the outwardly extending end of the shield 60 for engaging the inner periphery of the tank wall 16. The combined shield and wiper blade extends from the upper rim 12 of the roof 14 to the inner periphery of the tank wall 16 at an acute angle B with respect to the horizontal, with the length of the shield 60 being a selected dimension greater than the average width of the rim space 20 dimension to provide an effective sealing between the wiper blade 62 and the tank wall 16 even when the size of the rim space 20 varies during any lateral movement of the roof structure 14 with respect to the tank 16, as hereinbefore set forth in connection with the shield 11 and wiper blade 18.

The shield 60 preferably comprises a plurality of end-to-end or overlapping plates (not shown) similar to the plates 22, and the wiper blade 62 preferably comprises a plurality of end-to-end flexible strips similar to the strips 28. A static drain strip means 64 substantially identical to the static drain strip 30 is provided at each abutting joint between the wiper strips of the wiper blade 62 as hereinbefore set forth in connection with the strips 28. In addition, it may be preferable to provide a protective strip means (not shown) substantially identical to the protective strip means 44 in the proximity of each overlapping or abutting joint between the shield plates of the shield means 60, as hereinbefore set forth in connection with the shield means 11. It is to be noted however that the protective strip means is not usually required on the bottom seal. Of course, a yieldable sheet or film 68 is disposed against the surface of the shield 60 which is disposed away from the inner periphery of the tank wall 16 and is interposed between the shield 60 and rim 12 for the same purpose and in the same manner as hereinbefore set forth in connection with the film 26. The use of the two rim space sealing assemblies 10 and 58 provides a double seal for the rim space which essentially assures a leakproof connection between the inner periphery of the tank 16 and the floating roof 14, and the utilization of the film or sheets 26 and 68 assures an efficient seal at the connection between the shield members 11 and 60 and the rim 12 of the roof 14.

Figure 6:
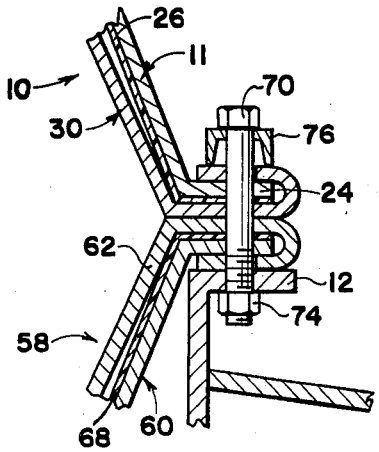
FIG. 6 is an enlarged sectional elevational view of the connection between the double sealing means embodying the invention and a floating roof structure having a horizontally disposed upper rim.

As hereinbefore set forth, the sealing assemblies 11 and 58 may be efficiently secured to a floating roof 14 of substantially any desired construction at the upper portion thereof. As particularly shown in FIG. 6, the assemblies 10 and 58 may be installed on the rim 12 by means of bolts 70 and cooperating lock nuts 72 and C-brackets 74 in the same general manner as securing of the single assembly 10 to the rim 12.

Figure 8:
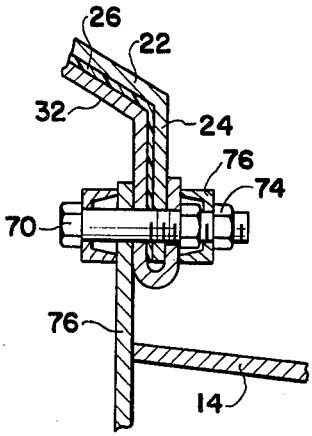
FIG. 8 is a view similar to FIG. 7 showing a single sealing means embodying the invention as installed on a floating roof structure having a vertically extending upper rim.
Figure 7:
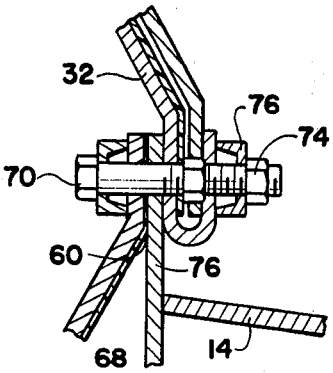
FIG. 7 is a view similar to FIG. 6 showing the double sealing means embodying the invention as installed on a floating roof structure having a vertically extending upper rim.

In the event the roof 14 is provided with a substantially vertically upwardly extending rim member 76 as shown in FIGS. 7 and 8, the flange 24 of the plates 22 may be formed or bent in a corresponding vertical configuration, as viewed in FIGS. 7 and 8, for disposition against the inner periphery of the upstanding rim 76 in the same manner as against the upper surface of the rim 12. The film or sheet 26 of yieldable material will be interposed between the flanges 24 and the flange 76, except at those positions along the circumference of the roof 14 wherein the static drain strips 30 are installed, or the protective members 44 are positioned. Similarly, the shield 60 of the sealing assembly 58 may be positioned against the outer periphery of the rim 76 oppositely disposed with respect to the flange 24, as particularly shown in FIG. 7, with the film 68 interposed between the shield 60 and rim 76.

From the foregoing it will be apparent that the present invention provides an improved sealing means for the rim space between a floating roof and a storage tank by providing an efficient and effective seal at the connection of the metallic shield with the metallic rim of the upper portion of the roof. The sealing means is provided with static drain means for passing any accumulated static electricity from the walls of the storage tank to the floating roof for substantially eliminating the hazards of static electricity in the system, thus providing an efficient and safe sealing for the rim spaced.

Whereas the present invention has been described in particular relation to the drawings attached hereto, it should be understood that other and further modifications, apart from those shown or suggested herein may be made within the spirit and scope of this invention.

What is claimed is:

1. Seal means for the rim space of a floating roof movably disposed within a storage tank and comprising flexible shield means having one end rigidly secured to the upper portion of the roof, wiper blade means provided at the opposite end of the shield means and engagable with the inner periphery of the storage tank to provide a seal therebetween, sealing liner means interposed between the shield means and the upper portion of the roof for precluding leakage therebetween, static drain means secured to the shield means and continuously engaged directly between the inner periphery of the storage tank and floating roof for passing any accumulated static electricity from the storage tank to the roof, the sealing liner means comprising yieldable sheet means disposed against and covering one face of the shield means and interposed between the shield means and roof for providing the sealing therebetween.

2. Seal means as set forth in claim 1 wherein the yieldable sheet means is a urethane sheet.

3. Seal means as set forth in claim 1 wherein the static drain means comprises at least one metallic strip secured to the shield means and wiper blade means and extending over and around the outer extremity of the wiper blade means for engagement with the inner periphery of the storage tank and extending over and around the end of the shield means secured to the roof for engagement with the roof for passing any accumulation of static electricity from the storage tank to the roof.

4. Seal means as set forth in claim 3 wherein the wiper blade means comprises a plurality of end-to-end abutting yieldable strips, and a static drain means is interposed between each adjacent pair of yieldable strips.

5. Seal means as set forth in claim 1 wherein the shield comprises a plurality of end-to-end flexible plates forming a continuous shield around the entire circumference of the floating roof, and protective means is secured in the proximity of each pair of adjacent plates for securing the wiper blade means to the plates.

6. Seal means as set forth in claim 5 wherein the end-to-end flexible plates are disposed in an overlapping relationship, and the protective means comprises strip means disposed in the proximity of each overlaping relationship and secured between the wiper blade means the respective plate.

7. Seal means as set forth in claim 1 wherein the flexible shield means extends outwardly and upwardly from the roof toward the inner periphery of the storage tank.

8. Seal means as set forth in claim 7 and including second seal means substantially identical to the first seal means to provide a double sealing for the rim space.

9. Seal means as set forth in claim 8 wherein the second seal means extends downwardly and outwardly from the roof toward the inner periphery of the storage tank.

* * * * *